US005813135A

United States Patent [19]

Michie et al.

[11] Patent Number: 5,813,135

[45] Date of Patent: Sep. 29, 1998

[54] CONDITIONING OF FABRICS BY RECIRCULATING AIR/STEAM METHOD AND APPARATUS

[75] Inventors: Neville A. Michie, Beacon Hill, Australia; David H. Tester, Ilkley, United Kingdom

[73] Assignee: Commonwealth Scientific and Industrial Research Organisation, Campbell, Australia

[21] Appl. No.: 737,861

[22] PCT Filed: May 17, 1995

[86] PCT No.: PCT/AU95/00285

§ 371 Date: Mar. 18, 1997

§ 102(e) Date: Mar. 18, 1997

[87] PCT Pub. No.: WO96/07784

PCT Pub. Date: Mar. 14, 1996

[30] Foreign Application Priority Data

May 18, 1994 [AU] Australia ..... PM5671
Feb. 14, 1995 [AU] Australia ..... PN1131

[51] Int. Cl.[6] ..... F26B 7/00

[52] U.S. Cl. ..... 34/381; 34/422; 34/430; 34/446; 34/452; 34/477; 34/542; 34/115; 34/649

[58] Field of Search ..... 34/381, 422, 430, 34/446, 452, 477, 491, 507, 542, 557, 77, 115, 131, 629, 649, 212, 219; 62/171, 176.6; 236/44 C; 26/92, 106

[56] References Cited

U.S. PATENT DOCUMENTS

| | | | |
|---|---|---|---|
| 2,157,975 | 5/1939 | Wilson | 34/542 X |
| 3,257,735 | 6/1966 | Catallo | 34/629 X |
| 3,503,231 | 3/1970 | Fleissner et al. . | |
| 3,786,573 | 1/1974 | Scheppe et al. | 34/371 |
| 4,358,899 | 11/1982 | Murch et al. | 34/507 |
| 4,858,448 | 8/1989 | Vecchia . | |
| 5,301,521 | 4/1994 | Bertoldo . | |
| 5,383,289 | 1/1995 | Webb et al. | 34/449 |

FOREIGN PATENT DOCUMENTS

| | | |
|---|---|---|
| 940107 | 2/1956 | Germany . |
| 1281992 | 11/1959 | Germany . |
| 1816004 | 7/1969 | Germany . |
| 2052440 | 5/1972 | Germany . |
| 2647198 | 4/1978 | Germany . |
| 2655972 | 6/1978 | Germany . |
| 2826390 | 6/1978 | Germany . |
| 2939902 | 4/1981 | Germany . |
| 3322645 | 12/1983 | Germany . |
| 1011424 | 12/1965 | United Kingdom . |
| 1121486 | 7/1968 | United Kingdom . |
| 1146954 | 3/1969 | United Kingdom . |
| 1193725 | 6/1970 | United Kingdom . |
| 1270279 | 4/1972 | United Kingdom . |
| 2125456 | 3/1984 | United Kingdom . |
| WO9405844 | 3/1994 | WIPO . |

*Primary Examiner*—Henry A. Bennett
*Assistant Examiner*—Steve Gravini
*Attorney, Agent, or Firm*—Sughrue, Mion, Zinn, Macpeak & Seas, PLLC

[57] ABSTRACT

The present invention is directed to a coaxial waveguide applicator for an electromagnetic wave-activated sorption system which comprises at least one sorber having a metallic tubular housing defining an outer conductor and first and second ends which are sealed to define an enclosure within the outer conductor; a sorbate/sorbent compound located within the enclosure; the sorber including a port through which a sorbate may be communicated into or out of the enclosure; a metallic inner conductor extending into the outer conductor and parallel to the longitudinal axis of the sorber; an electromagnetic wave generator; and a waveguide for coupling electromagnetic waves generated by the electromagnetic wave generator to the inner and outer conductors; wherein electromagnetic waves transmitted by the electromagnetic wave generator are propagated through the enclosure by the inner and outer conductors to desorb the sorbate from the sorbate/sorbent compound.

16 Claims, 4 Drawing Sheets

CONDITIONING OF FABRICS BY RECIRCULATING AIR/STEAM METHOD AND APPARATUS

TECHNICAL FIELD

This invention relates to apparatus and a process for rapidly conditioning textile fabrics that consist of or contain hydrophilic or hygroscopic material, for example such as wool. It will be convenient to hereinafter describe the invention with particular reference to the conditioning of wool fabrics or wool containing fabrics, but it is to be understood that the invention can be used for conditioning fabrics containing other types of fibres of known thermodynamic properties.

BACKGROUND

The conditioning of a textile fabric involves treating the fabric to increase its moisture content to a desired uniform level. The desirability of controlling the moisture content of fabrics to enhance processing operations and properties (for example look and feel) of final products is well known. For example, to enable wool containing fabric to be efficiently treated in a pressure decatiser requires the wool fibres to contain at least 15% regain moisture.

Known fabric conditioning processes include leaving the fabric spread out within an air conditioned room with the correct humidity for over twenty four hours to allow it to come to equilibrium with the ambient air, or, more usually, treating the fabric with a water spray or steam. The former method is slow and thus not cost efficient and the latter method, although more rapid, produces very variable results insofar as the moisture may reside on the outside surfaces of the fibres and not be incorporated within their structure, the moisture may not be uniformly distributed across a fabric (which problem is exacerbated if the moisture content of a fabric prior to the addition of water is unknown and not uniform), and the stability of the moisture content is not ensured.

Consequently a conditioning process which involves equilibrating a fabric with an atmosphere of known humidity and temperature, as in the former of the abovementioned known processes but which is much more rapid, is desirable. One proposal for such a process is disclosed in U.S. Pat. No. 3,604,124 in the name of Medley et al. This proposal involves providing a supply of air of closely controlled temperature and humidity, including ensuring that the total moisture content of the air is gaseous, and forcing it through a fabric. In the Medley et al process a relationship for the velocity of the air stream is given which includes the weight of the fabric as a factor. The patent also discloses apparatus for performing the process which includes a humidifying device. The Medley et al disclosure in relation to this humidifying device states "Air is humidified to controlled conditions by evaporation of water from a large surface area or by some other humidifying device such as mixing steam with the air . . . It is important that the total moisture content of the air is gaseous . . . This is achieved by temperature control by means of heating heat exchange surfaces . . . or by means of cooling heat exchange surface . . .".

The researchers involved in commercialising the Medley et al process were not able to develop apparatus to control the process variables with a sufficient degree of accuracy and consistency as to be cost effective for use in the textile industry. Consequently an apparatus as disclosed in the Medley et al patent has never been manufactured commercially.

DISCLOSURE OF THE INVENTION

The present invention offers an apparatus for performing a process similar to the Medley et al process (but in which there is not any relationship between the velocity of an air stream and the weight of a fabric being conditioned, as will be described herein below) in which the processing conditions are readily controllable.

According to the invention apparatus is provided for conditioning textile fabrics including, a chamber including means for transporting a fabric through the chamber, fan means having an inlet connected to draw an air stream through a fabric as it is transported through the chamber and an outlet connected to direct an air stream into the chamber, said inlet also being connected to receive ambient air, said chamber or said fan outlet also including means for humidifying at least a portion of the air stream from said fan means prior to its passage through a fabric, and control means for varying at least one of the flow rate of air through the chamber, the proportion of ambient air mixed with the air stream drawn through the fabric and the portion of the air stream that passes through the humidifying means to maintain the temperature and humidity of the air stream immediately before it passes through a fabric at predetermined values.

The portion of the air stream within the chamber or the fan outlet that does not pass through the humidifying means bypasses that means and is mixed with the portion that has passed through the humidifying means prior to the air passing through a travelling fabric.

Preferably the humidifying means includes a saturator for adiabatically saturating portion of the air stream that is passed therethrough (as will be described, the invention allows for the imperfect saturation that attends the use of practical saturators). Also the humidifying means may include a water eliminator following the saturator. This eliminator, which may be of any suitable form, removes any liquid droplets from the air stream which may be introduced by the saturator, thereby ensuring that the total moisture content of the air stream is gaseous.

The control means may include a digital computer and inputs for it may be provided by sensors for measuring flow rates, temperatures and humidity at various locations in the apparatus.

According to the invention, the humidity and temperature of an air stream that impinges on a fabric are maintained at desired values in a relatively simple manner, that is, by controlling merely a flow rate through the apparatus, the proportion of ambient air admitted to the inlet to the fan means and the proportion of the air stream within the chamber or the fan outlet that is passed through the humidifing means. Preferably the control aspect of the apparatus is further simplified by setting the total flow through the apparatus at a convenient value (in accordance with requirements to be described hereinbelow) such that only two parameters need to be variably controlled to maintain the desired temperature and humidity values. These two parameters are the proportion of ambient air entering the fan and the proportion of the air stream within the chamber that is passed through the humidifying means.

It is furthermore possible with the invention to avoid the use of humidity sensors, that is the control means may be such that temperature sensors only, together with flow rate sensors, are used in the apparatus. Although humidity sensors, such as wet bulb or electric sensors, may be used, these are best avoided as they are easily contaminated or damaged, and are difficult to keep calibrated to a sufficient degree of accuracy.

The invention also admits of even further simplification in relation to the humidifying means. As will be described in more detail hereinbelow, an embodiment of the humidifying means may comprise an air saturation device employing a water spray for wetting surfaces over which the air flows followed by a water eliminator to remove liquid droplets from the air stream, which is an arrangement in which the only control input need be the rate of water supply for the spray to keep the surfaces wet, and even this does not have to be closely controlled or even monitored. Thus a humidifying means according to the invention may be such as does not require, for example, any controllable heat input or monitoring of the temperature of the water supply.

In apparatus according to the invention, a process of rapidly conditioning fabric is carried out using air of controlled temperature and relative humidity to supply moisture to the fabric so that the fabric will increase its moisture content to a level known as the equilibrium regain for that temperature and humidity. The air is forced/drawn through the fabric to reduce the thickness of the impeding boundary layer of stationary air around the fibres which slows the conditioning process. The passage of air through the fabric provides a source of moisture to be absorbed and transports away the heat released by the process which would otherwise retard it. A decrease in the thickness of the boundary layer occurs and this, together with the removal of heat generated at the fibre surfaces allows the fabric to absorb moisture far more readily than if the process was allowed to occur passively. To ensure an economically viable rapidity for the process, it is necessary that the air velocity be sufficient to adequately reduce the thickness of the boundary layer around the fibres. As the air velocity through the fabric is increased the rate of transport of moisture to the fabric and heat away from the fabric is increased, but this concomitantly increases the cost of operating the process. Thus cost factors impinge on the choice of both a lower and an upper value for the velocity of air through a fabric.

The applicant has determined that the speed at which the conditioning occurs is proportional to the square root of the air velocity through the fabric (which establishes the thickness of the boundary layer through which the vapour must diffuse) and proportional to the saturated vapour pressure of water at the temperature of the process (which establishes the gradient and therefore the rate of diffusion of water vapour through the boundary layer). That is, contrary to the Medley et al disclosure, the process is not directly proportional to velocity and the fabric weight is not a significant input into the control of the conditioning process due mainly to the high air velocities that are contemplated for it.

Thus in an apparatus according to the present invention, it is not necessary that the velocity of an humidified air stream passing through a fabric be controlled or controllable in dependence on the weight of the fabric being conditioned. Preferably the humidified air is forced through a fabric at a velocity of about 1 meter per second. Velocities above this figure are increasingly uneconomical and velocities below about half a meter per second make the process uneconomically slow because of the increase of resistance of the boundary layer of stationary air on the fibres.

Thus the invention also provides a process for conditioning fabric including forcing a stream of conditioned air of predetermined temperature and relative humidity through a fabric while moving the fabric through a conditioning chamber, wherein the predetermined temperature and relative humidity are maintained by (a) admitting ambient air to a stream of recirculating conditioned air and varying the proportion of ambient air so admitted, and (b) saturating a portion of the total air stream that is forced through a fabric and varying the proportion so saturated and wherein the velocity of the conditioned air stream is preferably at least ½ m/s.

In investigating the conduct of a process according to the invention, the surprising discovery has been made that the process does not follow an expected "size of regain increase" versus "rate of change" relationship, that is, that a smaller jump in regain will be achieved more quickly than a larger jump. In fact, the contrary has been found to occur in that bringing a fabric into equilibrium with a set of conditions that require a jump of less than about 5% regain will occur more slowly than a larger jump in regain, for example, under one set of conditions a 10% regain increase occurred about four times faster than a 5% regain increase. However for regain jumps greater than about 5% it is possible that under some conditions a smaller jump to equilibrium will occur faster than a larger one. It has also been observed that a regain increase, regardless of its size, occurs faster at higher temperatures and for a given air velocity, and also that the rate of the process does not depend on the weight of the fabric.

To illustrate the abovementioned discovery, it has been observed that for an equilibrium process:

at 20° C. the process can change the regain of wool fabric from about 7% to about 12% in about 400 seconds.

at 20° C. the process can change the regain of wool fabric from about 7% to about 17% in approximately 100 seconds.

at 40° C. the process can change the regain of wool fabric from about 2% to about 13% in about 30 seconds.

at 60° C. the process can change the regain of wool fabric from about 2% to about 14% in about 15 seconds.

The following is offered to explain the abovementioned discovery, but it is to be understood that the explanation is only theoretical in that the actual mechanism that is involved has not yet been verified. When a swelling solvent such as water penetrates a glassy polymer such as wool and causes it to swell, there is an increase in the diffusion rate of the penetrant in the polymer. This increase occurs together with an increase in what is known as the free volume of the polymer and a decrease in its density. In the case of increased moisture content of a wool fibre due to being placed in contact with a humidity higher than that with which the fibre has previously come to equilibrium, the outer layers of the fibre become more conductive to the moisture diffusing into the fibre and this accelerates the rate that the inner layers can absorb more moisture. This process could be described as being autocatalytic. After the process has come to an equilibrium, the free volume will reduce with time, and the diffusivity of the moisture in the fibre will decrease. If a higher level of humidity is applied to the fibre, the increase of the free volume will be greater, the rate of increase in the diffusion rate will be higher, the rate of absorption of the inner layers will be higher, and the process in many instances will come to equilibrium in a shorter time than with the lower humidity. That is, in simplistic terms, when water from humid air penetrates wool it causes it to swell, but this penetration is limited, in the first instance, to the outermost layer of the wool fibre. The outermost layer of the fibre reaches a quasi-equilibrium with the humid air and an amount of "free volume" is created by the swelling. The degree of swelling and free volume is a function of the amount of water in the outer layer which is related to the relative humidity of the humid air. It is the amount of "free volume" that determines the rate of uptake of moisture by the fibre and its subsequent penetration into the fibre. For this reason, if two fibres at the same initial dry conditions are exposed to humid air, one at a higher relative humidity than the other, the fibre in the air at higher relative humidity will swell more and have more free volume in the outer layer. This fibre will have a subsequently greater capacity for water penetration and the rate of water uptake will be higher and in many instances the process will come to equilibrium faster. The swelling process is autocatalytic, and is an autoaccelerating process, that is, the more it swells the more water gets in and the faster it will continue to swell. After the process has come to an equilibrium, the free volume will reduce with time and the ability of moisture to diffuse into the fibre will decrease.

On the basis of the above described discovery, according to the invention in a further aspect a process for conditioning fabric is characterised by the achievement of a regain increase of at least x % within y seconds, wherein values for x and y will vary depending on the temperature at which the process is carried out and whether or not the increase is achieved as an equilibrium value. The process of conditioning, if stopped prior to equilibrium, can provide large regain increases in shorter times. It has been found for some conditions that the first 75% of the total regain change can occur in about 50% of the equilibrium time.

Example values for x and y are given in the following table:

| Regain Jump (x) % | Time seconds (y) | Process Conditions temperature, air flow |
|---|---|---|
| 5 | 400 | 20° C., 1 m/sec |
| 10 | 100 | 20° C., 1 m/sec |
| 9 | 50 | 30° C., 1 m/sec |
| 11 | 30 | 40° C., 1 m/sec |
| 13 | 20 | 50° C., 1 m/sec |
| 12 | 15 | 60° C., 1 m/sec |

The above results were determined for fabrics having a fibre diameter of 22 micron. It is expected that the times "y" would be faster for finer diameter fibres.

DESCRIPTION OF DRAWINGS

Embodiments of the invention will now be described, by way of example only, with reference to the accompanying drawings in which.

DETAILED DESCRIPTION OF EMBODIMENTS

Figure 1:
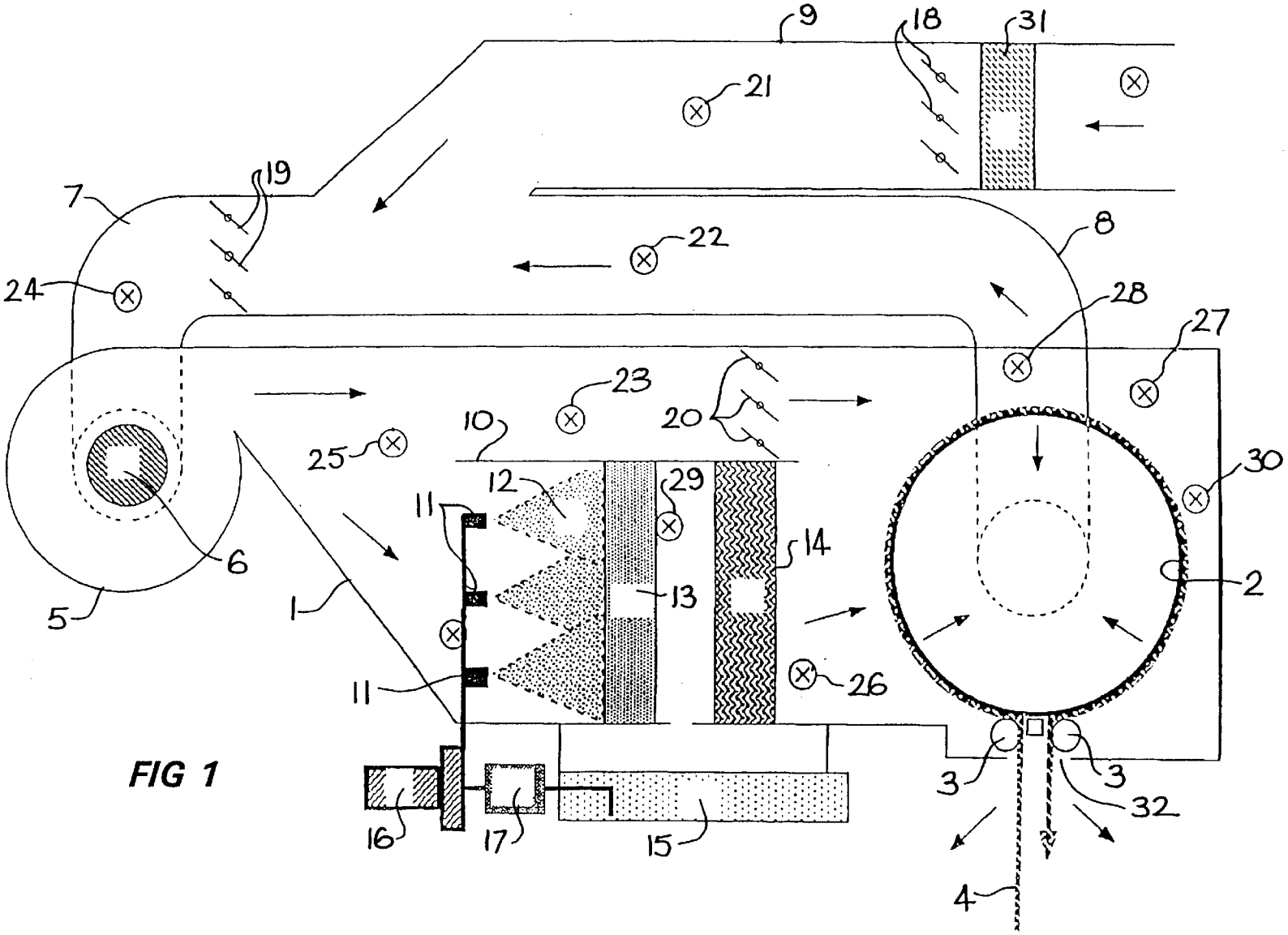
FIG. 1 is a schematic diagram of an example apparatus arrangement according to the invention.

The apparatus shown in FIG. 1 comprises a chamber 1 within which is mounted for rotation a perforated drum 2. Drum 2 may be rotatably driven by any suitable means. Guide rollers 3 located near an access aperture 32 in the chamber direct a fabric 4, for example of wool, which is to be conditioned onto drum 2 for transport through chamber 1, and off the drum for exit from the chamber. Conditioned air is forced/drawn through the fabric 4 and perforated drum as the fabric is transported on the drum such that the fabric exiting the chamber is in a conditioned state.

The apparatus includes an air pump fan 5 driven by a motor 6 for forcing a conditioned air stream through the fabric 4. An inlet 7 of fan 5 is connected to the outlet 8 for air drawn through the fabric 4 and drum 2 such that air is recirculated through the apparatus. Inlet 7 of fan 5 is also connected to a conduit 9 to receive ambient air. Conduit 9 includes a filter 31 to remove particles from any ambient air drawn into the apparatus. The outlet of fan 5 opens into chamber 1.

An air humidifying means 10 within chamber 1 comprises a series of water spray nozzles 11 which direct conical spray patterns 12 onto a saturator 13, which may be a particle bed or a series of thin plates along the flow path. Saturator 13 is followed by an eliminator 14 for removing water droplets from the air stream. Eliminator 14 comprises a series of louvres or vanes over which the air stream passes. The humidifying means, instead of being located within chamber 1, may be located between fan 5 and chamber 1.

Water from the humidifying means 10 collects (via gravity) in a sump 15 from which it is pumped by a pump 16, via a filter 17, to supply the spray nozzles 11.

Controls in the apparatus comprise a set of vanes 18 within inlet 9 to adjust the amount of ambient air admitted to the apparatus, a set of vanes 19 within inlet 7 of fan 5 for adjusting the total air flow through fan 5, and a set of vanes 20 within chamber 1 for adjusting the amount of air that bypasses the humidifier 10. The apparatus also contains air flow sensors as follows: 21 for the ambient air inlet, 22 for the return air from the drum 2, and 23 for the air bypassing the humidifier 10. Further sensors comprise thermometers as follows: 24 at the inlet of fan 5, 25 for the outlet air stream from the fan, 26 for the air exiting the humidifier 10, 27 for the air stream impinging on the fabric 4 on perforated drum 2, 28 for the air stream exiting the perforated drum 2, and 29 for the saturator 13.

Additional sensors that are preferably used are temperature and humidity sensors in the ambient air inlet conduit 9. These sensors are not essential, but their use allows information about the condition of the entering ambient air to be included in the control algorithm to increase the accuracy of the process. A humidity sensor at this location does not need to be rigorously calibrated or maintained. Also, pressure sensors at or near the thermometers 24, 27 and 28 are preferably included for fan management.

The apparatus may also include a humidity sensor 30 for the air impinging on the fabric, however this is not preferred for the reasons given herein above.

Figure 4:
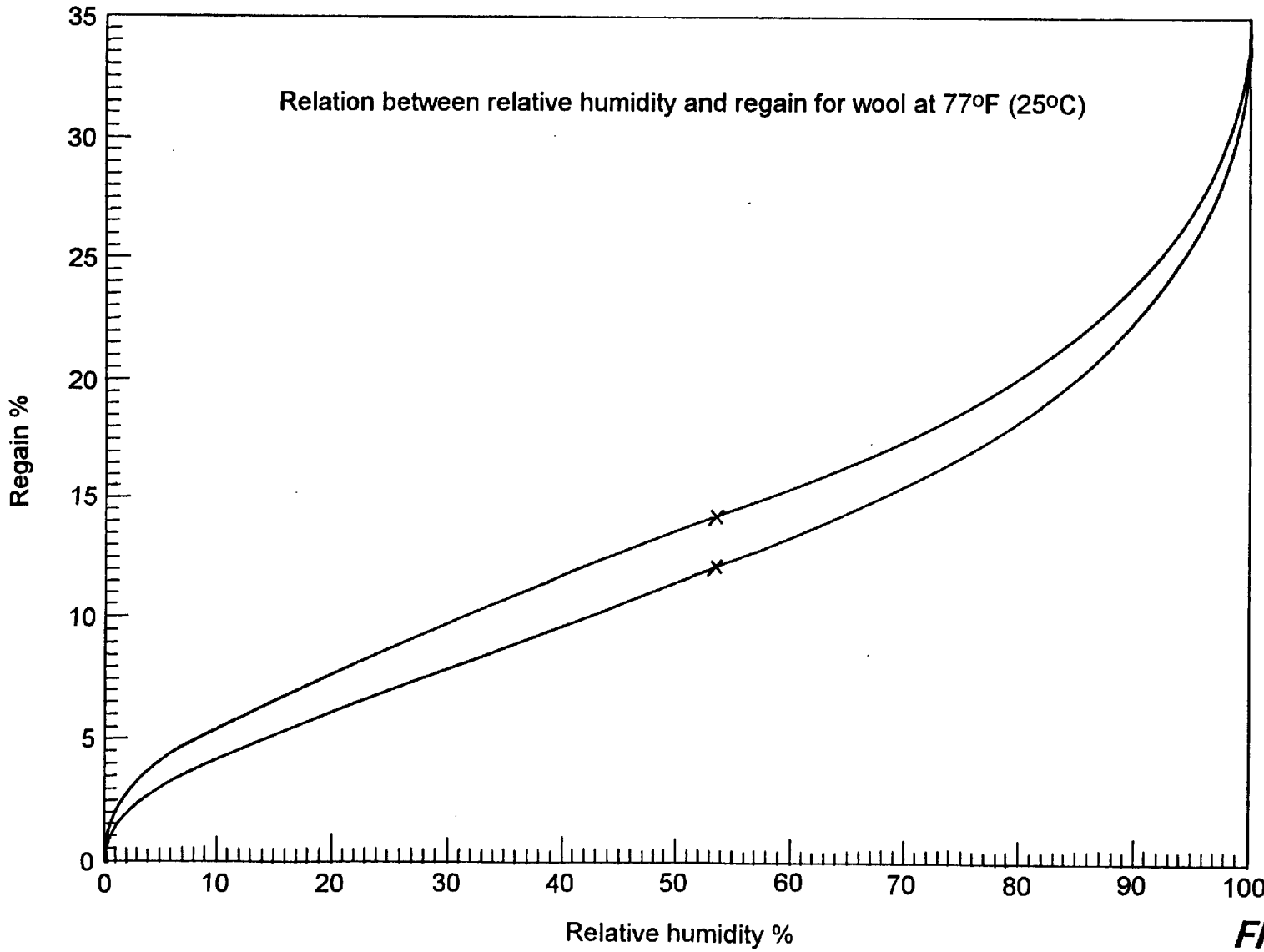
FIG. 4 is a graph showing a relation between relative humidity and regain for wool.

A control means for the apparatus (not shown) includes a small digital computer which is suitably programmed to operate means for adjusting the sets of vanes 18, 19 and 20 based on inputs from air flow sensors 21, 22, 23 and thermometers 24 to 29 (and possibly a humidity sensor 30). The temperature and humidity of the air is controlled by adjustments to vanes 18, 19 and 20 according to an algorithm that uses the temperature and air flow information throughout the apparatus combined with a model of the thermodynamic processes occurring in the fabric being conditioned. The thermodynamic model relates the rate of diffusion of moisture into a fibre and the rate of heat liberation therefrom. The computer program precisely predicts the temperature and humidity of the air at various stages of the process. Known relationships between equilibrium moisture content of textile fibres and the relative humidity and temperature of their environment can be used to determine the regain of the conditioned fabric. An example of such known relationships is provided by wool/ water isotherms such as the one shown in FIG. 4. Thus the thermodynamic modelling for a fabric that is to be conditioned may utilise information from isotherms such as shown in FIG. 4 to predict the relative humidity and temperature of an airstream that is required to achieve a given regain for a particular fabric.

In an embodiment of the invention, a drum 2 of diameter 0.5 meters and 0.6 meters width continually transports fabric through chamber 1 at a rate of about 3 meters per minute while air is drawn through the fabric and drum at a velocity of about 1 meter per second. The air drawn through the fabric 4 passes over thermometer 28 and is drawn into fan 5 after being mixed with ambient air from inlet 9 which has passed through filter 31 and is regulated by vanes 18. The total moisture in the return air stream and the ambient air stream is conserved as is the total enthalpy of the two streams. The air gains some heat as it passes through the fan, about 3 kilojoules per cubic meter, and exits at a pressure of about 3000 Pascals. Thus at measurement point 25 moisture is conserved but the enthalpy has increased. The air either passes through humidifier 10 or bypasses the humidifier via control vanes 20. The saturator 13 consists of thin metal plates 1.5 millimetres apart, 100 millimetres along the flow line, and is of area 1 square meter, and is sprayed with water at a rate of 1–5 liters per minute. A bed of particles has also been found to work as a saturator. The humidifier adiabatically saturates the air passing therethrough thus enthalpy is conserved but the moisture content increases. The air which has passed through the humidifier 10 is mixed with the air that bypasses the humidifier (enthalpy and moisture are conserved) and then is either drawn through the fabric being conditioned or escapes around the fabric access opening at 32.

As the air enters the fan 5 its temperature is measured at 24 and the thermometer at 25 measures the amount of heating of the air due to the mechanical work done on it by the fan. The air flows through the humidifier 10 (where the process of adiabatic saturation occurs with a previously measured degree of efficiency) and the temperature of the humidified air is measured at 26. For the high volume of air that the process requires, it is not economic to make a near perfect adiabatic saturator. An imperfect saturator will work in the process, but the temperature measured of the air leaving the saturator will not be the exact temperature of adiabatic saturation. The imperfect saturator is treated as being equivalent to a perfect saturator with a certain percentage of air bypassing it and combining at the output. The degree of inefficiency of the imperfect saturator is measured and the temperature of adiabatic saturation of the air at its output can be calculated. An algorithm is used to determine the temperature of perfect adiabatic saturation by iteration and the use of the calculation of the saturator with a measured degree of inefficiency. The temperature of the mixed humidified air and that which bypasses the humidifier is measured at 27. The measured temperatures and air flows are used to compute the settings of the rotatable control vanes 18 and 20 which enable control of the moisture of the air and the humidity. As the air passes through the fabric, water vapour is absorbed and heat is liberated. The temperature of the "de-conditioned" air that has passed through the fabric is measured at 28.

In an environment of ambient temperature 20° C. and relative humidity 50%, with an air pump heating rate of 3 kilojoules per kilogram of air and a fabric initially at zero moisture content, the apparatus can be adjusted to condition wool fabric to 20% moisture content at a temperature of 25° C., with an air flow through the fabric of 1 meter per second.

An algorithm that takes account of the intrinsic properties of the particular apparatus used and the thermodynamic properties of wool fibres used shows the required air relative humidity to be 81.8% with the fabric passing through the apparatus in 60 seconds. To achieve this the algorithm shows the need for the following adjustments:

vanes at 18 set so that the ratio of added air is 11.6% of the flow, the vanes at 20 set so that the total bypass ratio of the humidifier (including the inefficiency component of the saturator) is 29.7% of the flow.

These adjustments will result in a temperature of adiabatic saturation (computed from the algorithm using temperature measurements at 25 and 26 and the bypass ratio) of 22.6° C. and the condition of the air presented to the fabric as 25° C. and 81.9% humidity.

For the same ambient conditions, if the conditioning temperature is required to be 40° C. then the ratios of added air and saturator bypass would need to be 2.9% and 32.5%. The calculated temperature of adiabatic saturation would be 37.2° C., and the condition of the air presented to the fabric as 40° C. and 83.9% relative humidity. The fabric would pass through the machine in 30 seconds.

Figure 2:
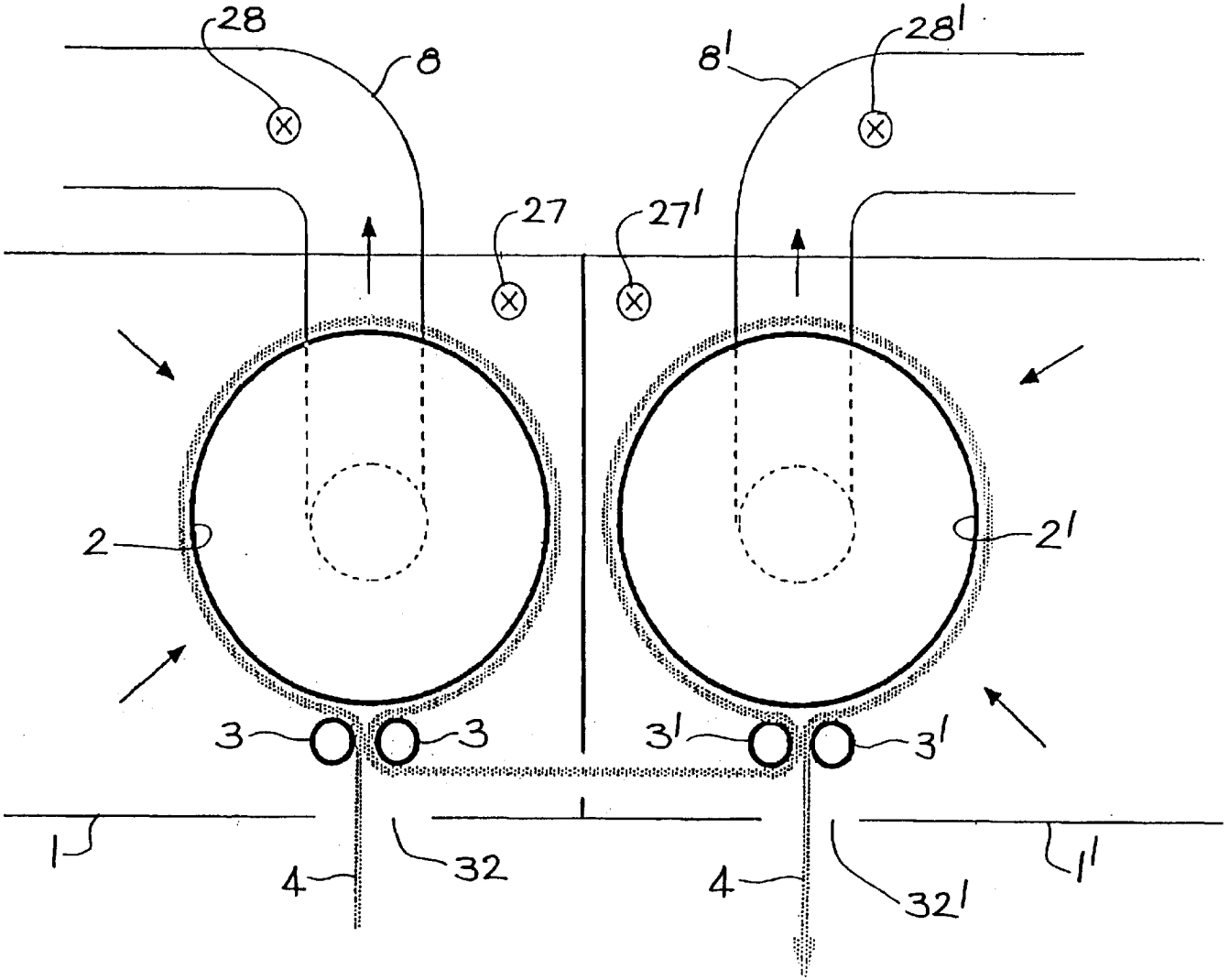
FIG. 2 is a schematic diagram of part of another example apparatus arrangement according to the invention.

FIG. 2 illustrates a "back-to-back" arrangement of two sets of apparatus as in FIG. 1, wherein a fabric 4 can be successively transported through the humidifying chambers 1, 11 of each system via drums 2 and 21. This arrangement offers advantages in speed and energy consumption as the first chamber traversed may be run at a high temperature and at full air velocity, which speeds the process, and the second chamber may be run at a much lower air velocity thus saving much of the air pump energy cost. The second chamber may also be run at a lower temperature, delivering the fabric at room temperature and avoiding subsequent rapid loss of moisture.

Figure 3:
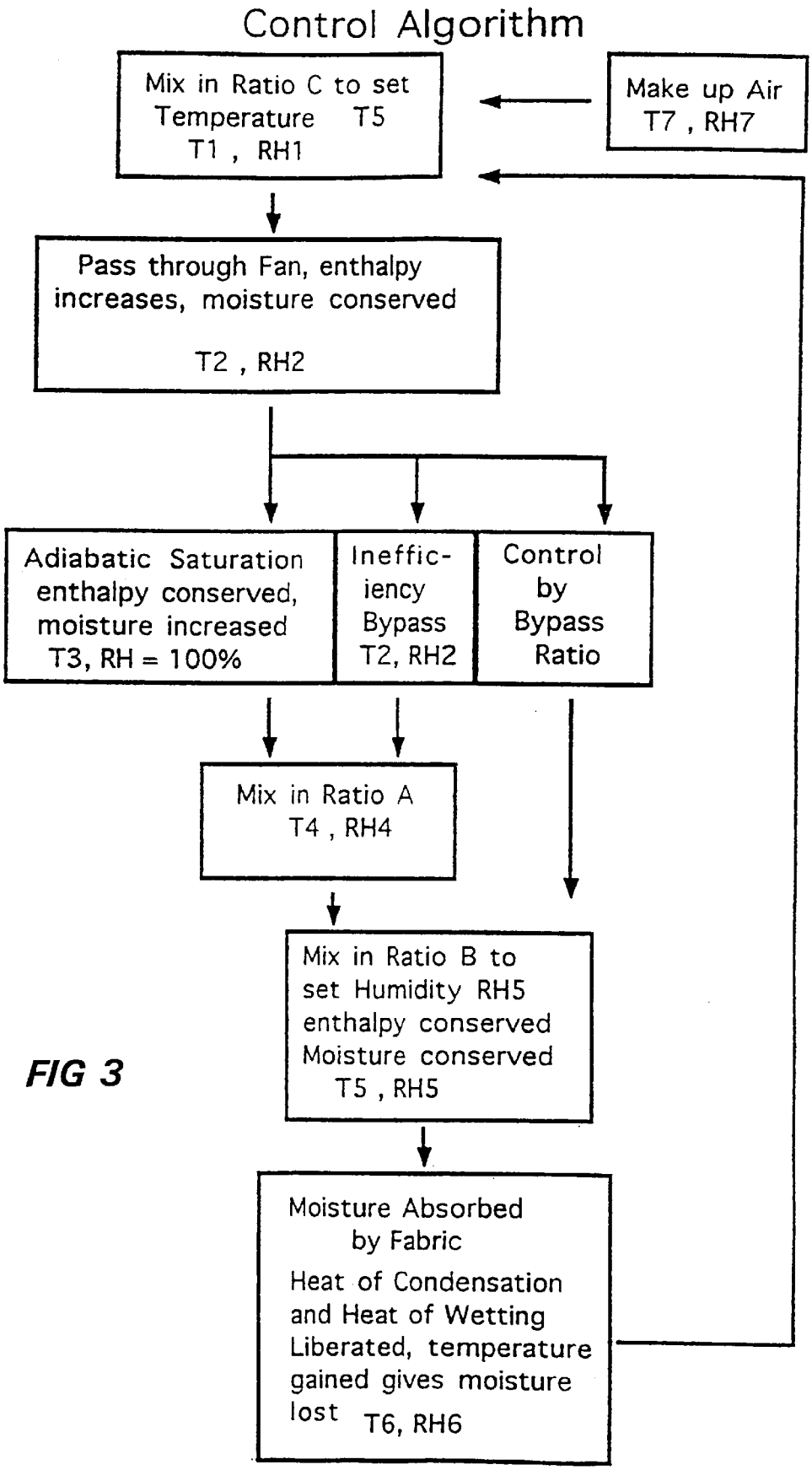
FIG. 3 illustrates a control algorithm for the apparatus of FIG. 1.

FIG. 3 shows the principal parts of a control algorithm for apparatus as shown in FIG. 1. Starting with the inlet to the air fan, the temperature and humidity T1, RH1, are known from the previous condition of the air. When the air passes through the fan, the flow rate of the air is known from the flow sensors, and the heating power from the fan's action can be calculated from the temperature rise as the air passes through the fan. By calculating the condition of the air with increased enthalpy, but conserving the moisture unchanged, the condition of the air at the exit of the fan is calculated, T2, RH2 using procedures such as those published by the ASHRAE: 1989 ASHRAE Handbook, "FUNDAMENTALS". Published by American Society of Heating Refrigeration and Air Conditioning Engineers, Inc. Atlanta.

The air flow is divided after the fan, one flow passes through a saturator. The temperature of the air leaving the saturator would be an accurate measure of the humidity of the air before the saturator, if the process was completely efficient. By making measurements of the efficiency of this part of the machine, a factor may be determined that enables a correction to be applied to the temperature T3 so that the humidity is determined. The correction is in the form of a ratio A which is the effective rate of air bypassing a perfect saturator. The ratio B of air that is passed by the saturator is determined by the measurement of flow rates and is used as the principal control of humidity in the machine. The bypassed air is mixed with the air from the saturator and its condition is calculated by assuming the conservation of both enthalpy and moisture, T5, RH5.

Some of the air leaves the machine at this stage, to prevent outside air coming in contact with the fabric and as a means of transporting the excess heat from the machine. The conditioned air is drawn through the fabric at a measured rate determined by the flow sensors, and two processes occur: Moisture is absorbed by the fabric, and latent heat of condensation and the Heat of Wetting are released by the fabric. The quantity of moisture absorbed by the fabric is calculated from the measured rise in temperature of the air as it passes through the fabric. The weight of the absorbing component of a blend fabric or the weight of the fabric if it is of pure wool (or other such fibre) can be determined from this measurement. Computational procedures are used that incorporate the published thermodynamic data of the specific heat of wool over a range of temperatures and moisture contents and the heat of wetting over a range of moisture contents and the psychrometric properties of moist air to determine the humidity of the air after it has passed through the fabric, T6, RH6.

The air returning to the fan is mixed in a ratio C with ambient air to control the temperature of the process, the ratio being determined by the flow rate measurements. The measurement of the humidity of the makeup air requires a humidity sensor, but its influence on the precision of the process is not high, and it is not expected to need a rapid response, so that available humidity measuring sensors should prove adequate.

The rate of response of a particular machine will depend on physical factors such as the weight of materials in its construction and the volumes of air and water in the machine. The control algorithm includes terms that anticipate the slowed response of the whole system so that fluctuations in the system will be smoothly accommodated and conditions will be accurately maintained.

Apparatus according to the invention may also be used for "sponging" a wool fabric. The process of fabric sponging involves taking an unconstrained fabric and raising its temperature/regain to a point where it exceeds the glass transition of the wool protein and allows cohesively held stresses and strains to be released. Sponging may be used to release shrinkage in fabric. The use of air of high relative humidity and high temperature to provide the required conditions for sponging, and forcing the air through the fabric at high velocity to break down the fabric boundary layer and provide a mechanism to remove heat of condensation and absorption is possible with apparatus according to the invention.

Persons skilled in the art will appreciate that the invention described herein is susceptible to variations, modifications and/or additions other than those specifically described and it is to be understood that the invention includes all such variations, modifications and/or additions which fall within the spirit and scope of the following claims.

We claim:

1. Apparatus for conditioning textile fabrics including, a chamber including means for transporting a fabric through the chamber, fan means having an inlet connected to draw an air stream through a fabric as it is transported through the chamber and an outlet connected to direct an air stream into the chamber, said inlet also being connected to receive ambient air, said chamber or said fan outlet also including means for humidifying at least a portion of the air stream from said fan means prior to its passage through a fabric, and control means for varying at least one of the flow rate of air through the chamber, the proportion of ambient air mixed with the air stream drawn through the fabric and the portion of the air stream that passes through the humidifying means to maintain the temperature and humidity of the air stream immediately before it passes through a fabric at predetermined values.

2. Apparatus as claimed in claim 1 wherein the humidifying means includes a saturator for adiabatically saturating said portion of the air stream from said fan means.

3. Apparatus as claimed in claim 1 wherein the humidifying means includes a water eliminator for removing liquid droplets from said portion of the air stream from said fan means.

4. Apparatus as claimed in claim 2 wherein said saturator includes a series of thin plates that extend longitudinally in the direction of flow of said portion of the air stream, and spray means for spraying water onto said thin plates.

5. Apparatus as claimed in claim 3 wherein the said water eliminator comprises a series of louvres or vanes over which the air stream passes.

6. Apparatus as claimed in claim 1 wherein the said control means includes a set of vanes for varying the flow rate through the chamber, a set of vanes for varying the amount of ambient air admitted into the chamber and a set of vanes for varying the proportion of air stream that passes through the humidifying means.

7. Apparatus as claimed in claim 6 wherein the said control means includes sensors for measuring flow rates and temperatures of said air streams.

8. Apparatus as claimed in claim 7 wherein said control means includes a programmed digital computer.

9. Apparatus as claimed in claim 8 wherein said computer receives signals from said sensors and said computer provides output signals for adjusting the position of said sets of vanes.

10. Apparatus as claimed in claim 1 wherein said means for transporting a fabric through the chamber comprises a perforated drum mounted for rotation within said chamber.

11. A process for conditioning fabric including forcing a stream of conditioned air of predetermined temperature and relative humidity through a fabric while moving the fabric through a conditioning chamber, wherein the predetermined temperature and relative humidity are maintained by (a) admitting ambient air to a stream of recirculating conditioned air and varying the proportion of ambient air so admitted, and (b) saturating a portion of the total air stream that is forced through the fabric and varying the proportion so saturated.

12. A process as claimed in claim 11 wherein the predetermined temperature and relative humidity are such that the regain of the fabric is increased by a minimum of at least 5% within a time period not greater than 400 seconds.

13. A process as claimed in claim 11 wherein the velocity of the conditioned air stream is at least ½ m/s.

14. A process as claimed in claim 12 wherein a regain increase of at least 5% is achieved within 200 seconds.

15. A process as claimed in claim 12 wherein a regain increase within the range of 5% to 10% is achieved within 100 seconds or less.

16. A process as claimed in claim 12 wherein a regain increase of at least 10% is achieved within at least 50 seconds.

* * * * *